US008876673B2

(12) United States Patent
Inglut

(10) Patent No.: US 8,876,673 B2
(45) Date of Patent: Nov. 4, 2014

(54) ISOLATED UPPER-BODY EXERCISE DEVICE

(71) Applicant: Derrick Jeffrey Inglut, West Hollywood, CA (US)

(72) Inventor: Derrick Jeffrey Inglut, West Hollywood, CA (US)

( * ) Notice: Subject to any disclaimer, the term of this patent is extended or adjusted under 35 U.S.C. 154(b) by 0 days.

(21) Appl. No.: 13/828,339

(22) Filed: Mar. 14, 2013

(65) Prior Publication Data

US 2014/0135183 A1 May 15, 2014

Related U.S. Application Data

(63) Continuation-in-part of application No. 13/673,903, filed on Nov. 9, 2012.

(51) Int. Cl.
*A63B 21/068* (2006.01)

(52) U.S. Cl.
CPC ..... *A63B 21/068* (2013.01)
USPC ..... 482/96; 482/95

(58) Field of Classification Search
USPC ..... 482/96, 92–95, 23, 38–40, 41–43, 140, 482/141, 142–147
See application file for complete search history.

(56) References Cited

U.S. PATENT DOCUMENTS

| | | | | |
|---|---|---|---|---|
| 5,417,628 | A | 5/1995 | Vanderbleek | |
| 5,961,430 | A * | 10/1999 | Zuckerman et al. | 482/142 |
| 6,022,304 | A * | 2/2000 | Tornabene et al. | 482/140 |
| 2006/0217246 | A1 * | 9/2006 | Payne | 482/96 |
| 2012/0225759 | A1 | 9/2012 | Tsai | |
| 2012/0329613 | A1 * | 12/2012 | Schiano | 482/94 |

OTHER PUBLICATIONS

Nick Nilsson, Bodyweight Preacher Curls for Thrashing your Biceps, BetterU News, Jun. 5, 2008, pp. N/A, Issue 8, Nick Nilsson, Internet publication—http://www.fitstep.com/Misc/Newsletter-archives/issue60/preacher-curls.htm.

* cited by examiner

*Primary Examiner* — Loan H Thanh
*Assistant Examiner* — Megan Anderson

(57) ABSTRACT

An exercise device for training the Biceps, Posterior Deltoids and Latissimus Dorsi using an exerciser's body weight that has a support pad and a fixed curl bar on a frame at an elevated position. The exerciser grasps the curl bar, rests his or her forearms on the support pad and lift his or her body to perform the exercise.

2 Claims, 15 Drawing Sheets

ISOLATED UPPER-BODY EXERCISE DEVICE

This application is a continuation-in-part of prior application Ser. No. 13/673,903, filed Nov. 9, 2012.

BACKGROUND

1. Field of the Invention:

This invention relates to exercise devices. Specifically those exercise devices that provide targeted anaerobic exercise through the use of the exerciser's body weight.

2. Description of Prior Art:

Physical exercise provides well known benefits. When performed properly and on a regular basis, physical exercise helps individuals control weight, combat health conditions and diseases, improve emotional well-being, increase energy and improve sleep.

Although overlap is common, athletes generally categorize exercises into aerobic exercise and anaerobic exercise. Aerobic exercise improves the strength and efficiency of the exerciser's cardiovascular and pulmonary systems. Anaerobic exercise increases the efficiency and number of muscle fibers affected by a particular exercise.

Because anaerobic exercise primarily affects the muscle fibers targeted by a particular exercise, exercisers often perform exercises that isolate and target a particular muscle group.

Exercisers and athletes often attempt to train muscle groups in a manner that allows them to develop muscle fibers while improving their cardiovascular health. This type of training often involves performing several different anaerobic exercises with little or no rest between exercises. An example of this type of training is the Cross Fit style of training. Cross Fit requires an exerciser to perform, for example, push-up followed immediately by pull-ups and other compound exercises.

A variety of exercise devices have been developed to help exercisers isolate and target a particular muscle group. These devices often use an additional component to provide resistance during an exercise. For example, U.S. Pat. No. 6,746,382 B2 describes a device for targeting an exerciser's quadriceps and relies on elastic bands to provide resistance.

A variety of exercise devices have been developed that rely on the exerciser's body weight for resistance. U.S. Pat. No. 7,892,157 B2 discloses an exercise device that allows the exerciser to perform a variety of exercises using his or her body weight as resistance. While U.S. Pat. No. 7,892,157 B2 relies on body weight for resistance, it does not support the exerciser's body in a manner that prevents the exerciser's non-targeted muscle groups from assisting in an exercise.

Devices that isolate the biceps are common in the prior art. U.S. Pat. No. 5,256,125 discloses a biceps curling machine. The device successfully targets the exerciser's biceps, but has the disadvantages of requiring a large mechanical frame and heavy metallic weights for resistance and it fails to develop the exerciser's Posterior Deltoids and Latissimus Dorsi. These devices also have the disadvantage of requiring time to set up and, therefore, preventing the exerciser from combining aerobic and anaerobic training.

SUMMARY

The invention disclosed in an exercise device that targets the exerciser's biceps and supporting muscle groups while using the exerciser's body weight as resistance.

Objects and Advantages

A person's body weight can provide significant resistance during exercise. The U.S. military services, for example, use a combination of push-ups, pull-ups and sit-ups as a significant portion of their strength training programs for new recruits. Therefore, the proposed invention has the following intentions a) To provide a device that targets the exerciser's biceps, posterior deltoids and latissimus dorsi b) To provide the exerciser with the opportunity to perform exercises without the need for heavy metallic weights or elastic bands with varying resistance c) To provide the exerciser with the opportunity to exercise his or her biceps without needing to spend time adjusting or setting up the exercise device d) To offer a device that allows the exerciser to train his or her biceps, posterior deltoids and latissimus dorsi while being able to quickly transition to other exercises

BRIEF DESCRIPTION OF THE SEVERAL VIEWS OF THE DRAWINGS Overview:

All the drawings are listed as FIGS. 1 through 8. Each part in the drawings is numbered 100 through 900.

Reference Numerals In Drawings

100—The preferred embodiment of the device
200—The frame of the device
201—The first rigid member
202—The second rigid member
203—The left-most rigid member
204—The right-most rigid member
205—The left-most horizontal rigid member
206—The right-most horizontal rigid member
207—The left-most angled rigid member
208—The right-most angled rigid member
209—The third rigid member
210—The left-most pad support rigid member
211—The right-most pad support rigid member
212—The fourth rigid member
213—The fifth rigid member
300—The support pad
301—The door-mounted support pad
400—The curl bar
401—The door-mounted curl bar
402—The left-most end of the door-mounted curl bar
403—The right-most end of the door-mounted curl bar
404—The gripping areas of the door-mounted curl bar
500—The mounting means
600—A stand-alone embodiment of the exercise device
601—The support base for the stand-alone embodiment of the exercise device
602—The left-most frame extension of the stand-alone embodiment of the exercise device
603—The right-most frame extension of the stand-alone embodiment of the exercise device
604—The left-most pad support of the stand-alone embodiment of the exercise device
605—The right-most pad support of the stand-alone embodiment of the exercise device
606—The horizontal rigid member of the stand-alone embodiment of the exercise device
607—The right-most angled rigid member of the stand-alone embodiment of the exercise device
608—The left-most angled rigid member of the stand-alone embodiment of the exercise device

700—The contoured tubes of the door-mounted exercise device

701—The curved sections of the contoured tubes

702—The upper pad support sections of the contoured tubes

703—The horizontal pad support sections of the contoured tubes

704—The lower pad support sections of the contoured tubes

705—The pad support rigid member

706—The first transition areas

707—The second transition areas

708—The third transition areas

709—The upper ends of the contoured tubes

800—The rectangular rigid member

801—The wall contact surface of the rectangular rigid member

802—The door frame contact surface of the rectangular rigid member

900—The supporting rigid member

901—The left-most end of the supporting rigid member

902—The right-most end of the supporting rigid member

903—The protective coating on the ends of the supporting rigid members

LIST OF FIGURES

FIG. 1 depicts an example of the exercise device mounted on an exercise cage FIG. 2 depicts an example of the exercise device as viewed from a rear perspective FIG. 3 depicts an example of the exercise device as viewed from a side profile and mounted onto an exercise cage FIG. 4 represents view A-A as defined in FIG. 3 and depicts an example of the device's pad support structure FIG. 5 depicts an example of the exercise device as viewed from a side profile and mounted onto a wall FIG. 6 depicts the front view of the exercise device as a stand-alone unit FIG. 7 depicts the rear view of the exercise device as a stand-alone unit FIG. 8 depicts the side view of the exercise device as a stand-alone unit FIG. 9 depicts an example of the exercise device mounted on an exercise cage with an exerciser at the beginning stage of the exercise FIG. 10 depicts an example of the exercise device with an exerciser approaching the finishing position of the exercise FIG. 11 depicts an example of the exercise device viewed from the side with an exerciser approaching the finishing position of the exercise.

DETAILED DESCRIPTION OF THE INVENTION

The following description provides specific details and a thorough understanding of the embodiments of the invention. One skilled in the relevant art, however, will recognize that the invention can be practiced without one or more of the specific details or in combination with other components.

Figure 1:
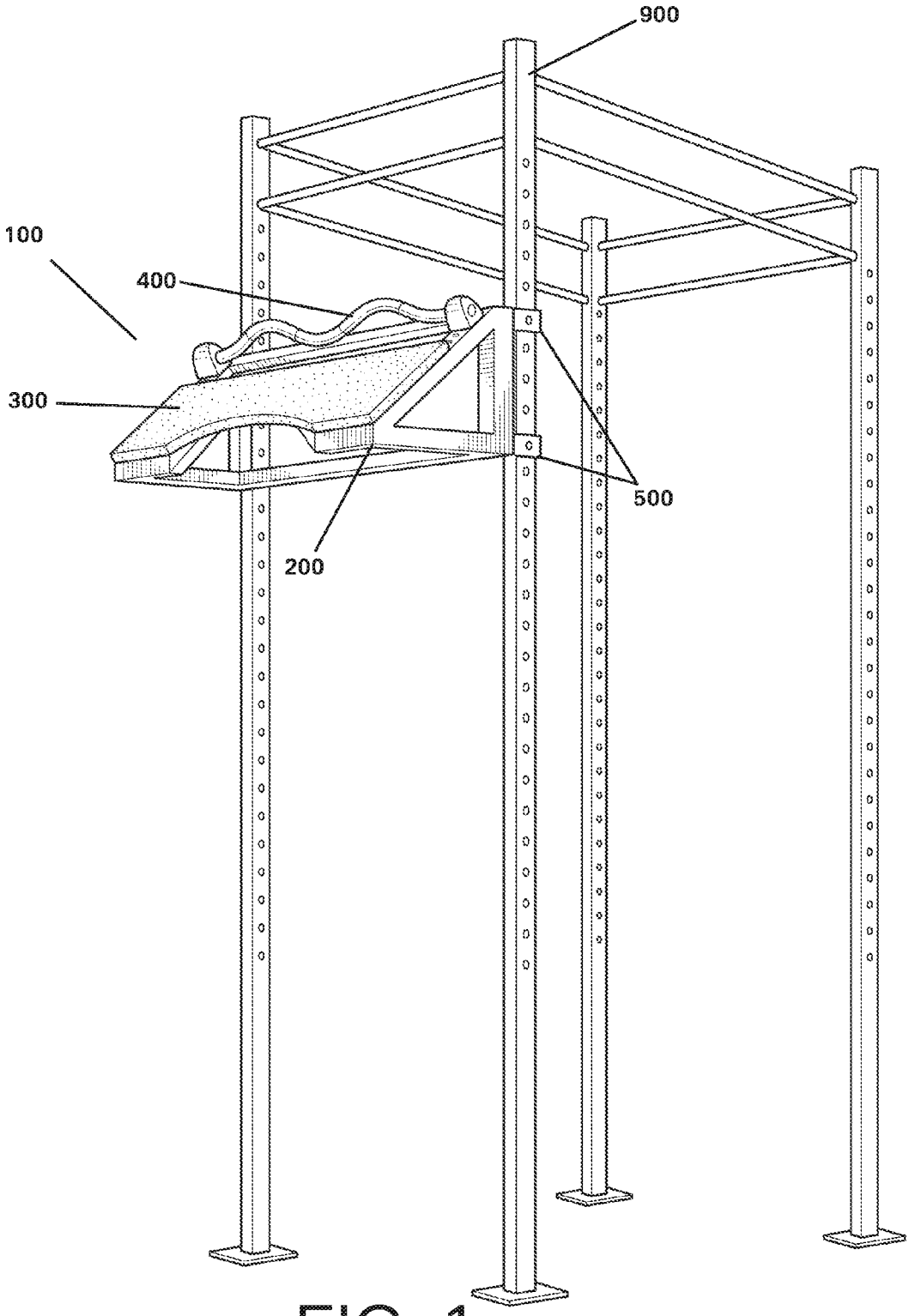

FIG. 1 depicts an example of the exercise device 100 mounted onto an exercise cage 900. The example exercise device 100 includes a frame assembly 200, a support pad 300, a curl bar 400 and mounting provisions 500.

Figure 2:
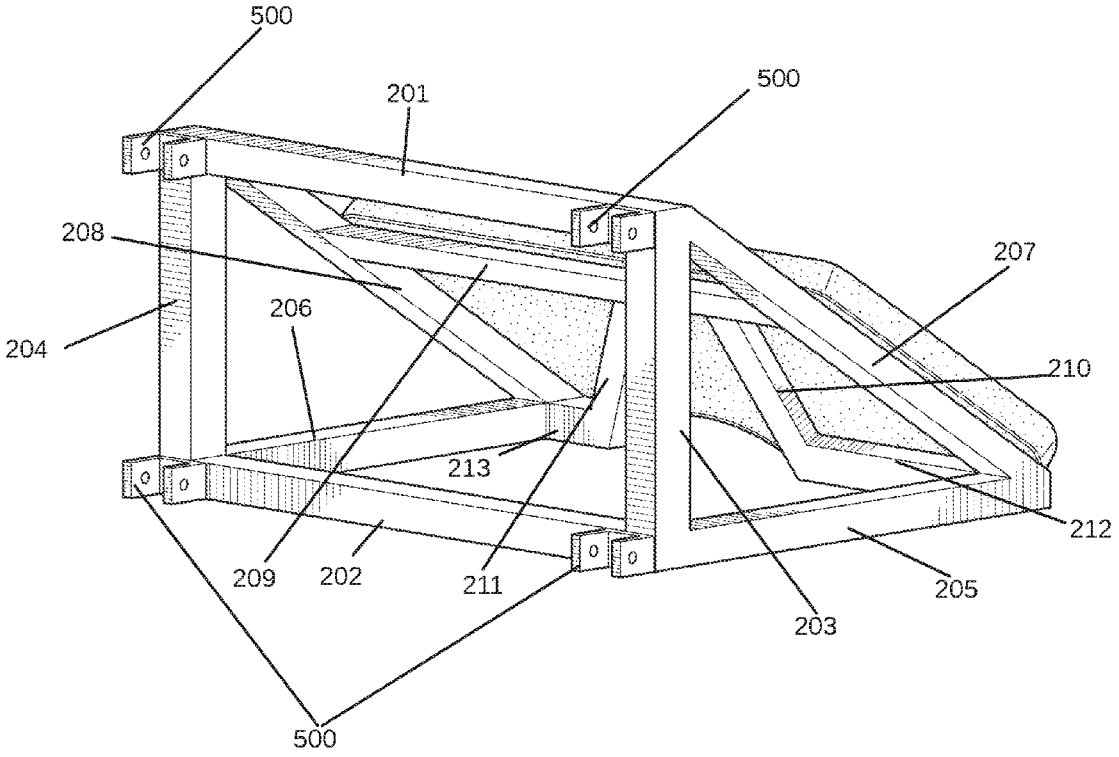

FIG. 2 is a rear perspective view of an example of the exercise device 100. The example exercise device 100 includes a frame assembly 200 with a first rigid member 201, a second rigid member 202, a left-most rigid member 203, a right-most rigid member 204, a left-most horizontal rigid member 205, a right-most horizontal rigid member 206, a left-most angled rigid member 207, a right-most angled rigid member 208, a third rigid member 209, a left-most pad support rigid member 210, a right-most pad support rigid member 211, a fourth rigid member 212 and a fifth rigid member 213.

In the preferred embodiment, the first rigid member 201, second rigid member 202 and third rigid member 209 will be of equal length. However, one skilled in the art will recognize that the first rigid member 201, second rigid member 202 and third rigid member 209 may be cut to any suitable length to satisfy a particular application. For example, larger cuts may be used to target men while smaller cuts may be used to target women.

In the preferred embodiment, the first rigid member 201 and second rigid member 202 are horizontally oriented, spaced a distance apart and on the same plane. The left-most rigid member 203 is joined to the left-most ends of both the first rigid member 201 and the second rigid member 202. The right-most rigid member 204 is joined to the right-most ends of both the first rigid member 201 and the second rigid member 202. When viewed from the rear, the joined first rigid member 201, second rigid member 202, left-most rigid member 203 and right-most rigid member 204 will form a generally square or rectangular shape.

Figure 3:
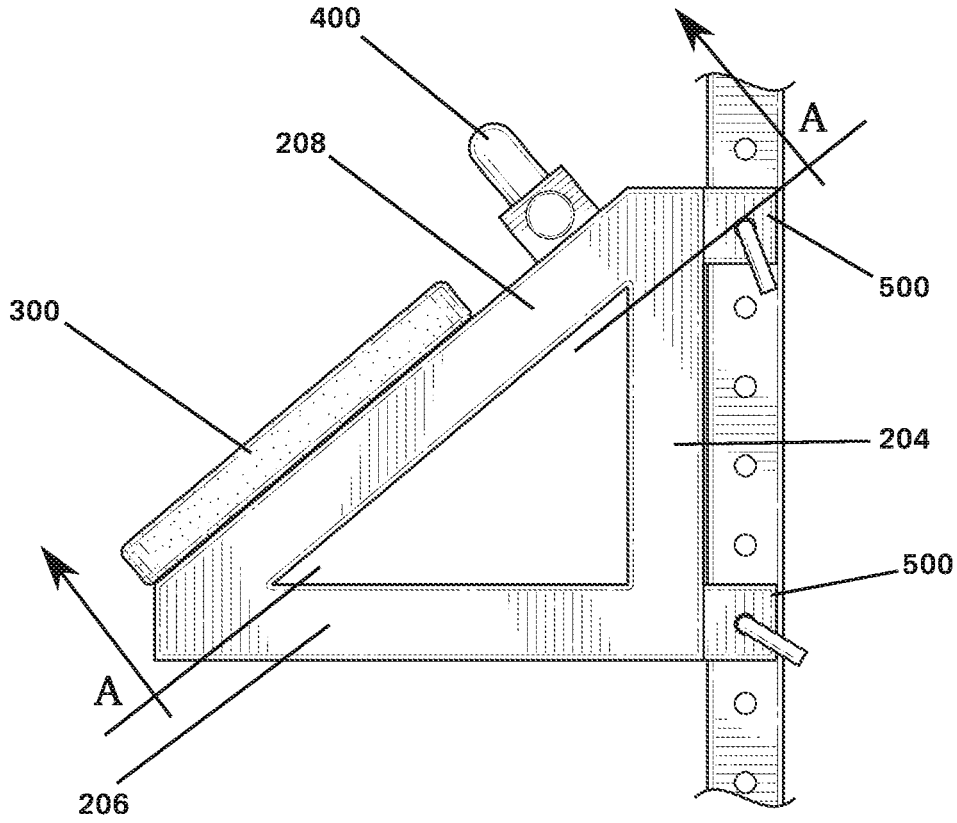

Continuing with the preferred embodiment, FIG. 3 depicts a side profile of the exercise device. As shown in FIG. 3, the right-most horizontal rigid member 206 is joined at the junction of the second rigid member 202 and the right-most rigid member 204. The right-most angled rigid member 208 is joined with both the right-most horizontal rigid member 206 and at the junction of the right-most rigid member 204 and the first rigid member 201. Similarly, as shown in FIG. 2 the left-most horizontal rigid member 205 is joined at the junction of the second rigid member 202 and the left-most rigid member 203. The left-most angled rigid member 207 is joined with both the left-most horizontal rigid member 205 and at the junction of the left-most rigid member 203 and the first rigid member 201. When viewed from the side and as depicted in FIG. 3, the joined right-most horizontal rigid member 206, right-most rigid member 204 and right-most angled rigid member 208 will form a generally triangular shape. Similarly, the joined left-most horizontal rigid member 205, left-most rigid member 203 and left-most angled rigid member 207 will form a generally triangular shape. In the preferred embodiment, the angle formed between the left-most angled rigid member 207 and the left most horizontal rigid member 205 will be between 45 and 50 degrees. This angle has been determined to provide maximum benefit from the exercise while promoting safe usage of the device.

Figure 4:
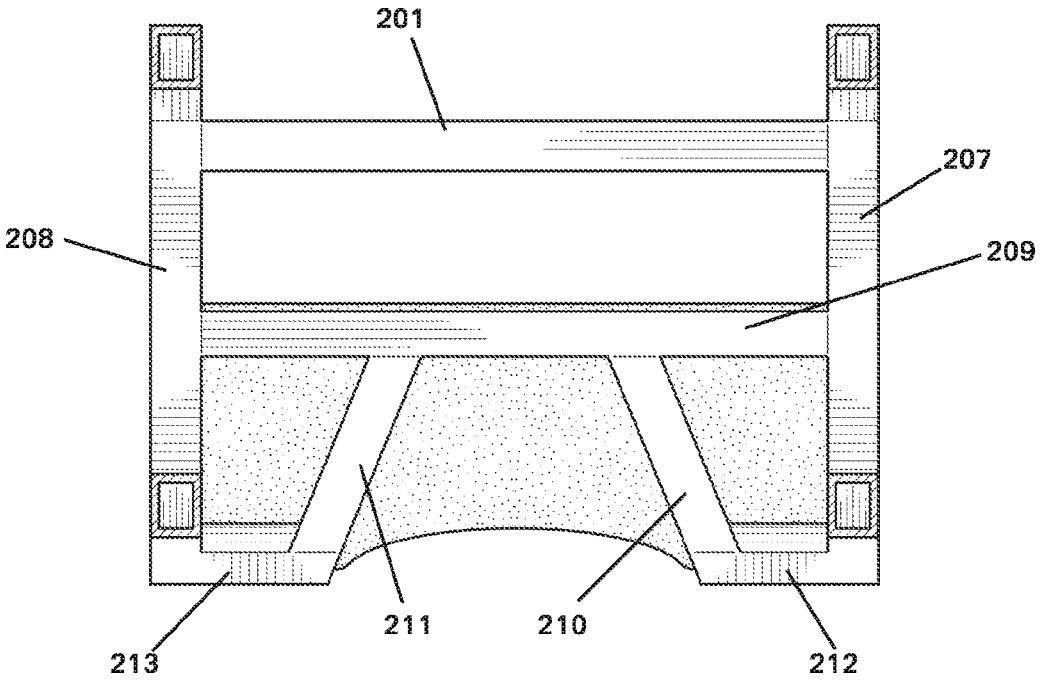

FIG. 4 depicts the view A-A as defined in FIG. 3. FIG. 4 depicts the pad support portion of the exercise device's frame. In the preferred embodiment, the fourth rigid member 212 is joined at the junction of left-most angled rigid member 207 and the left-most horizontal rigid member 205. Similarly, the fifth rigid member 213 is joined at the junction of the right-most angled rigid member 208 and the right-most horizontal rigid member 204. The third rigid member 209 is located a distance between the first rigid member 201 and both the fourth rigid member 212 and the fifth rigid member 213 and joined with the left-most angled rigid member 207 and the right-most angled rigid member 208. The left-most pad support rigid member 210 is joined with the third rigid member 209 and the fourth rigid member 212. Similarly, the right-most pad support rigid member 211 is joined with the third rigid member 209 and the fifth rigid member 213. When viewed from view A-A, the joined third rigid member 209, fourth rigid member 212, fifth rigid member 213, left-most pad support member 210 and right-most pad support rigid member 211 will form a trapezoidal shape with a missing base.

While the combination of joined third rigid member 209, fourth rigid member 212, fifth rigid member 213, left-most pad support member 210 and right-most pad support rigid member 211 will form a trapezoidal shape with a missing base in the preferred embodiment, one skilled in the art will recognize that this feature is preferred but not necessary for the device. The exercise device will function with the fourth rigid member 212 and the fifth rigid member 213 joined as a single rigid member spanning the distance between the left-most angled rigid member 207 and the right-most angled rigid member 208 and with the left-most pad support rigid member 210 and right-most pad support rigid member 211 removed from the device.

As depicted in FIG. 3 and FIG. 2., a support pad 300 is mounted onto the structure formed by the right-most angled rigid member 208, the left-most angled rigid member 207, the third rigid member, 209, the fourth rigid member 212, the fifth rigid member 213, left-most pad support member 210 and right-most pad support member 211. The support pad 300 can be made with any material, but will preferably be made with a wooden support material covered with foam and vinyl as is typical in the art to cushion the exerciser's arms. In the preferred embodiment, the support pad will contain a cut-out on the side closest to the fourth rigid member 212 and fifth rigid member 213 and parallel to the third rigid member 209. The cut-out will be sized to provide enough space so that an exerciser's stomach does not prevent the exerciser from performing the exercise in a full range of motion.

As depicted in FIG. 1, the exercise device will have a curl bar 400 that spans the distance between the left-most angled rigid member 207 and the right-most angled rigid member 208. The curl bar 400 is mounted on to the left-most angled rigid member 207 and the right-most angled rigid member 208. In the preferred embodiment, the curl bar 400 is curved to support an exerciser's wrists in a manner commonly known as an EZ curl bar. However, the curl bar 400 can be straight or contain any variety of angles.

Figure 5:
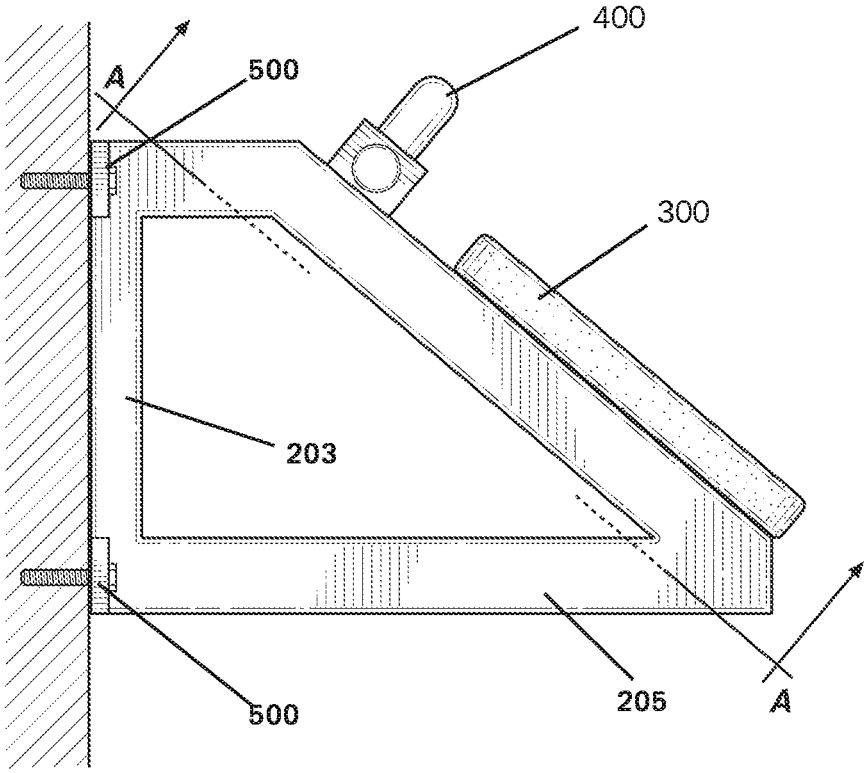

FIG. 1 depicts the exercise device mounted onto a functional training cage 900. The exercise cage 900 depicted in FIG. 1 is an example of exercise cages that are common in the art. The exercise cage 900 generally consists of several rigid members with sets of coaxial holes spaced a distance apart. The device is mounted onto the functional training cage 900 by mounting provisions 500. In the preferred embodiment, the mounting provisions 500 are joined at the junctions of the first rigid member 201, the left-most rigid member 203 and right-most rigid member 204 as well as at the junctions of the second rigid member 202, the left-most rigid member 203 and right-most rigid member 204. In the preferred embodiment, the mounting provisions will consist of two coaxial holes that will accept a pin, bolt or rod that will support the device and the weight of the exerciser. The coaxial holes in the exercise device will be aligned with the coaxial holes in the exercise cage 900 and a pin, bolt or rod will pass through both the coaxial holes in the exercise cage 900 and the exercise device's mounting provisions 500 in order to support the weight of the device and the exerciser. Alternative embodiments include a wall mounted version of the device as depicted in FIG. 5. As depicted in FIG. 5, the mounting provisions 500 are joined to the device with the device supported on a wall by a series of screws or bolts.

Figure 6:
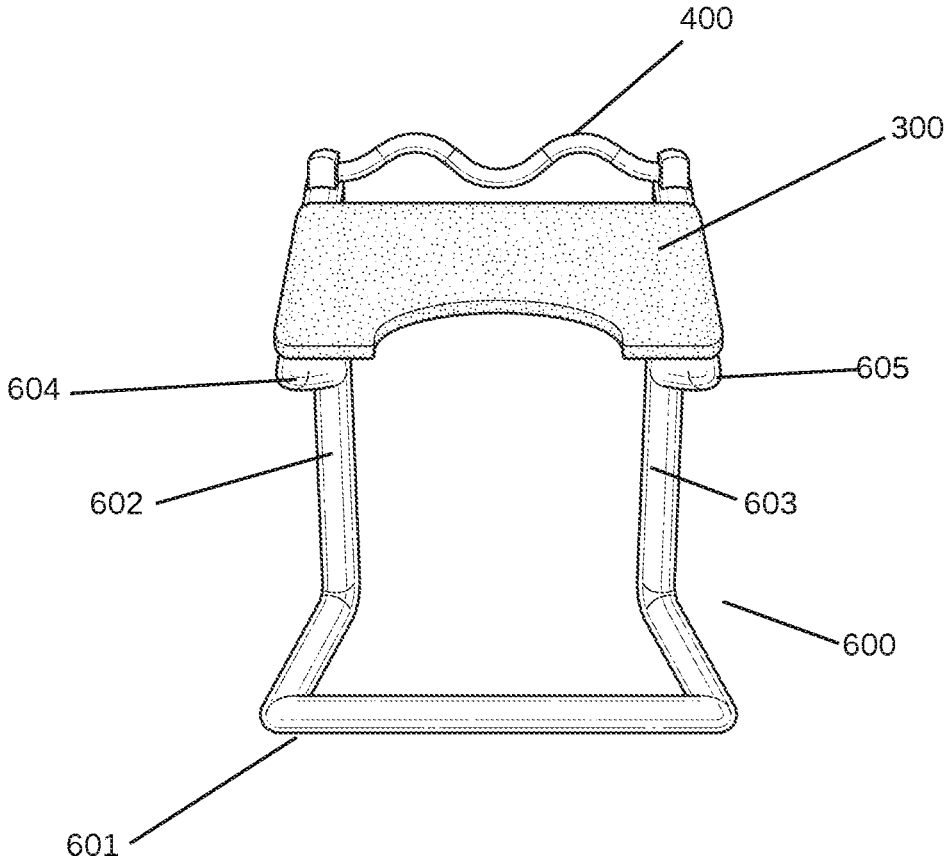
Figure 8:
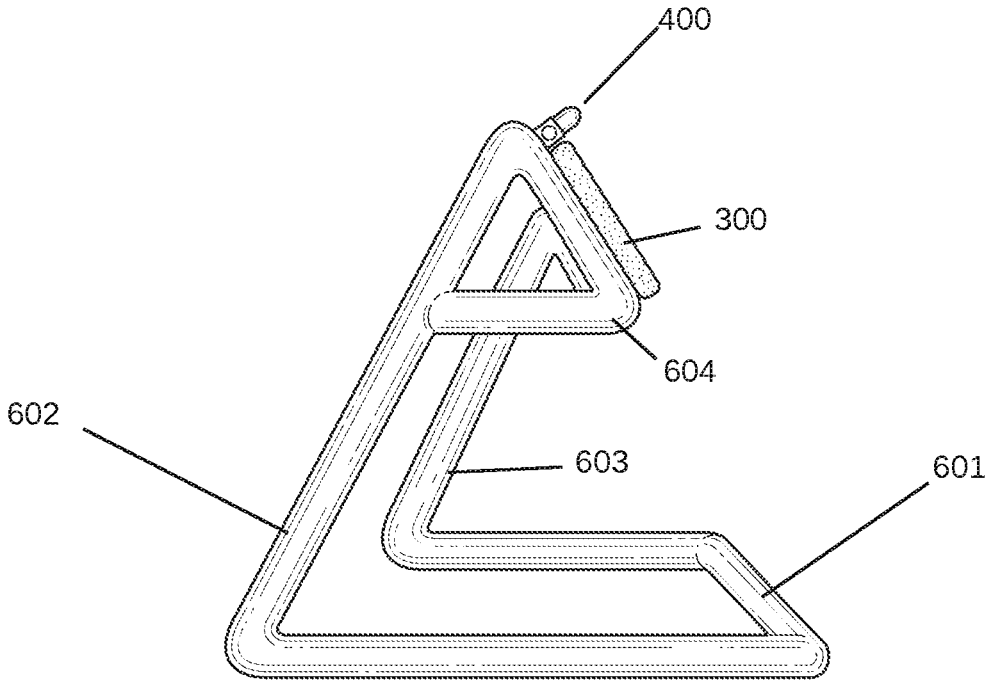

FIG. 6 depicts an alternate embodiment of the exercise device where the device is a fixed stand-alone unit. As shown in FIG. 6, the support pad 300 and curl bar 400 are mounted onto the fixed stand-alone unit. The frame 600, as depicted, consists of a support base 601, left-most frame extension 602, right-most frame extension 603, left-most pad support 604 and right-most pad support arm 605. As depicted in FIG. 8, the support base 601 extends a distance sufficient to assure that the device remains upright when being used. The left-most frame extension 602 and right-most frame extension 603 are joined to the support base 601 and extend a height sufficient to allow a user to perform the exercise without touching the ground.

As depicted in FIG. 8, the left-most frame extension 602 and right-most frame extension 603 are joined to the support base 601 at an angle that positions the user over the support base 601. The left-most pad support arm 604 is joined with the left-most frame extension 602 at the end opposite of the support base 601 and forms an angle preferably between 45 and 55 degrees from the ground. Similarly, the right-most pad support arm 605 is joined with the right-most frame extension 603 at the end opposite of the support base 601 and forms an angle preferably between 45 and 55 degrees from the ground. In this alternate embodiment, the left-most pad support arm 604 and right-most pad support arm 605 are formed so that there are horizontal components that rejoin the left-most frame extension 602 and right-most frame extension 603, respectively, at positions between the opposing ends of the left-most frame extension 602 and right-most frame extension 603. The horizontal components of the left-most pad support 604 and right-most pad support 605 are intended to provide additional structural support for the exercise device. However, one skilled in the art will recognize that the horizontal components of the left-most pad support 604 and right-most pad support 605 are not absolutely necessary for the exercise device.

Figure 7:
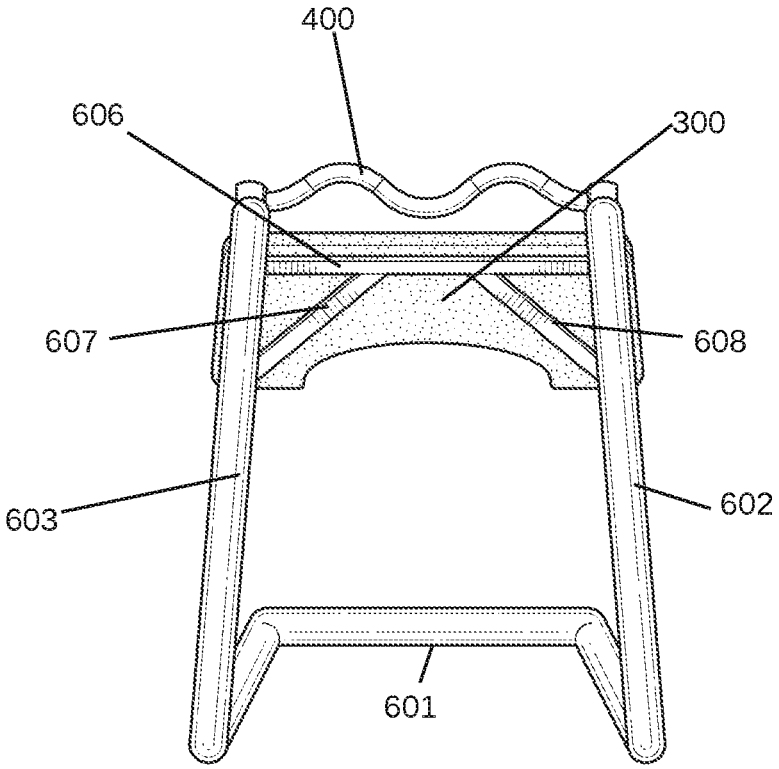

FIG. 7 depicts a rear view of this alternate embodiment of the device. As seen in FIG. 7, a horizontal rigid member 606 is joined to the left-most pad support 604 and right-most pad support 605. A right-most angled rigid member 607 is joined to the horizontal rigid member 606 and the right-most pad support 605. Similarly, a left-most angled rigid member 608 is joined to the horizontal rigid member 606 and the left-most pad support 604. The support pad 300 is mounted onto the left-most pad support 604 and right-most pad support 605 and is structurally supported by the horizontal rigid member 606, right-most angled rigid member 607 and left-most angled rigid member 608. The curl bar 400 is mounted onto the left-most pad support 604 and right-most pad support 605.

Although FIGS. 6, 7 and 8 depict the left-most frame extension 602 and right-most frame extension 603 as attached to the end of the support base 601 and forming an angle to position the user over the support base 601, one skilled in the art will recognize that the left-most frame extension 602 and right-most frame extension 603 can be vertical and positioned anywhere on the support base 601 that will maintain the device in the upright position.

Although three embodiments of the exercise device are described, one skilled in the art will recognize that this invention includes any embodiment that the support pad 300 and curl bar 400 to be placed in an elevated position so that the exerciser can grasp the curl bar, rest his or her forearms on the support pad and lift himself or herself from the ground. These other embodiments of the device include, but are not limited to, mounting the device onto a doorway, wall, or other exercise device. One skilled in the art will recognize that the device can be mounted by any means necessary to accomplish a particular mounting goal.

Figure 9:
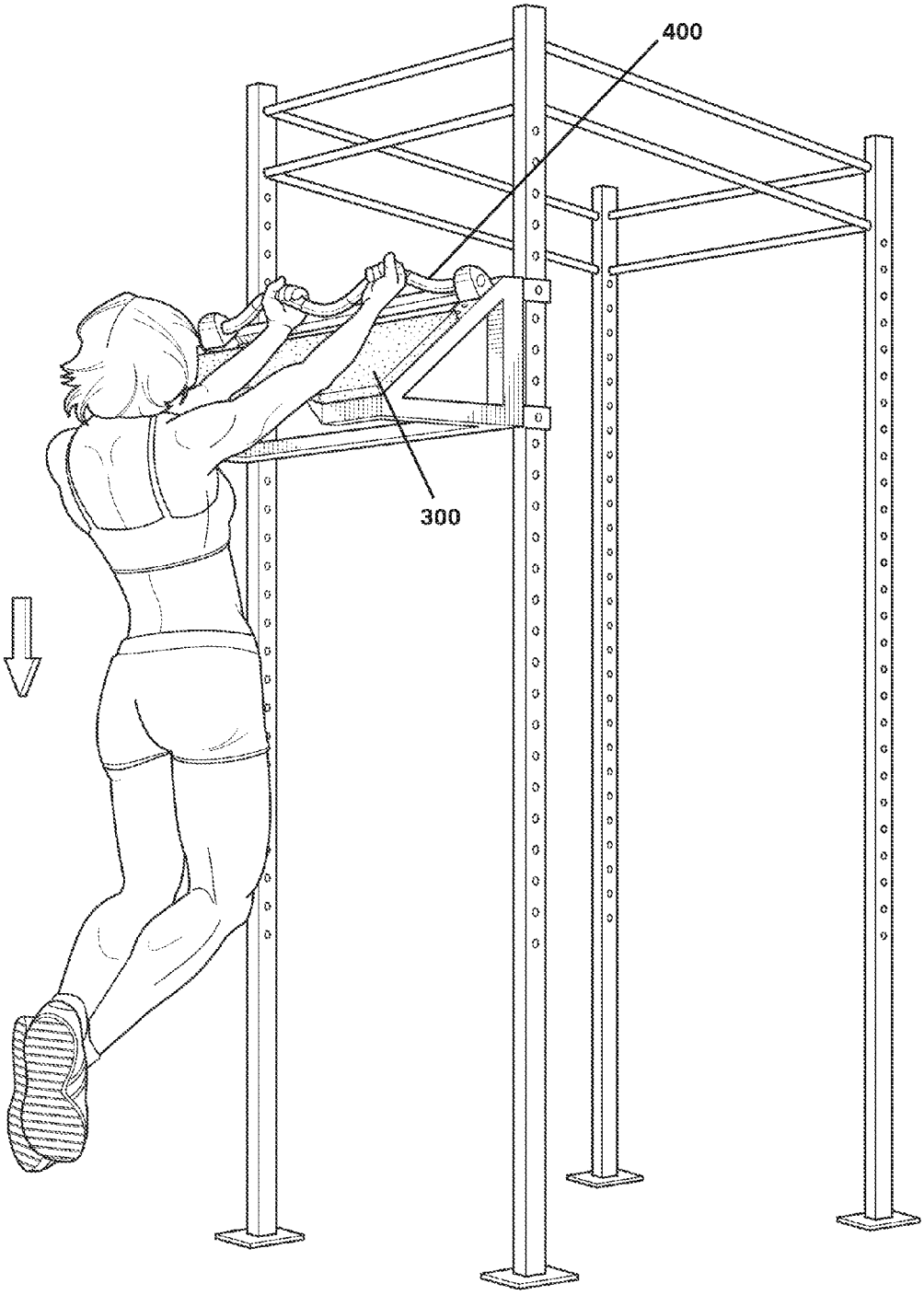
Figure 10:
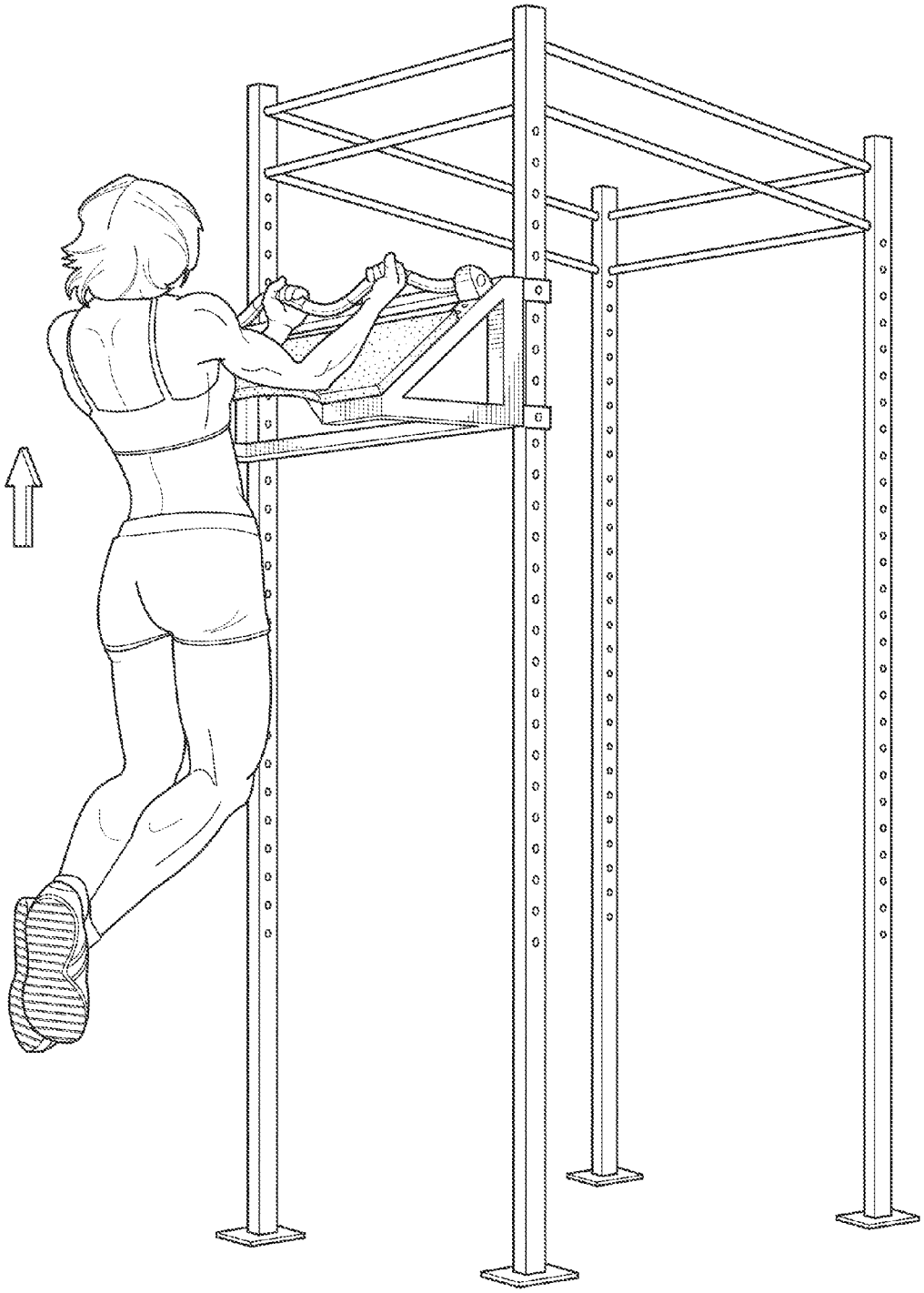
Figure 11:
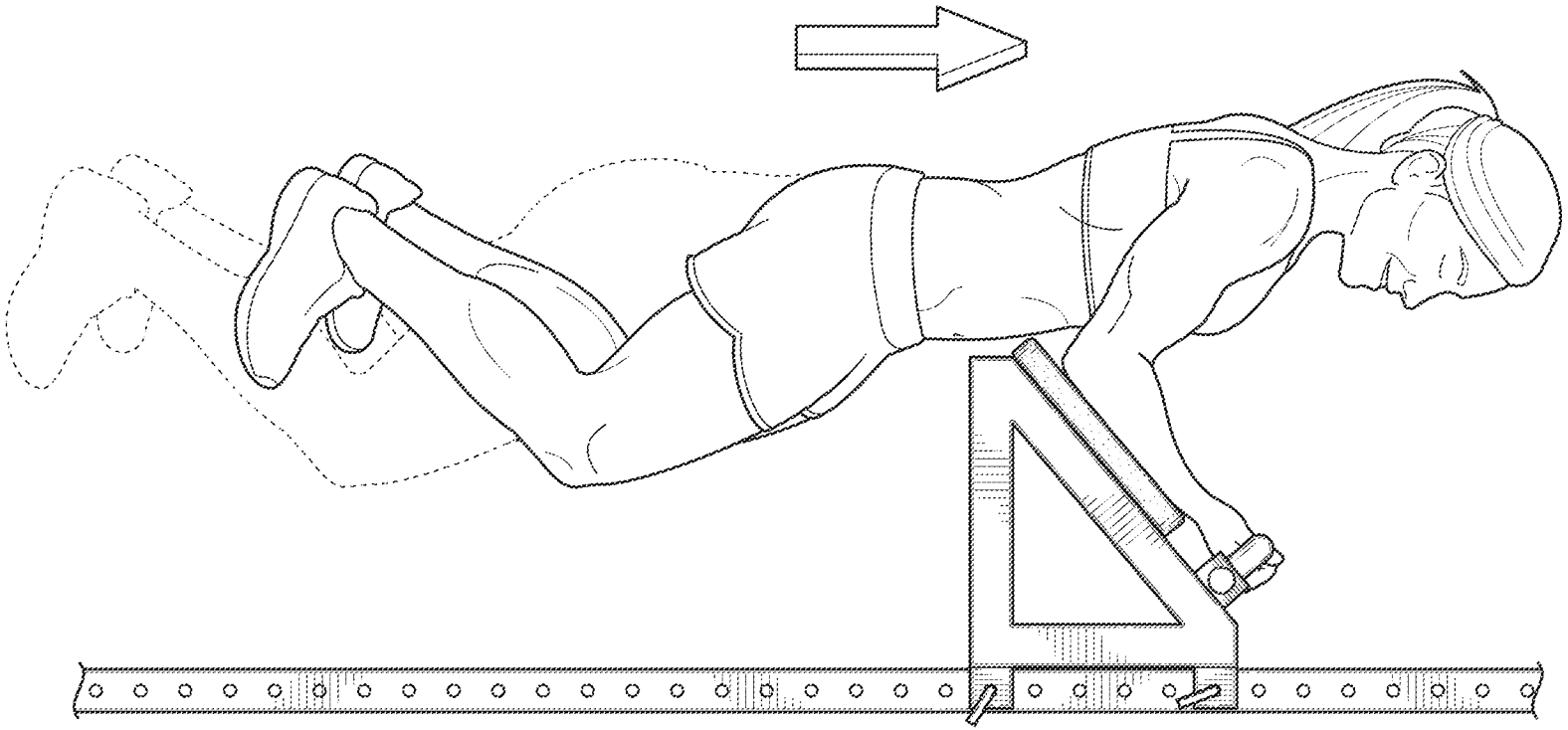

FIG. 9 depicts an exerciser using the preferred embodiment of the device. The exerciser will grasp the curl bar 400 and rest his or her elbows and forearms on the support pad 300. As shown in FIG. 10, the exerciser will contract his or her forearms, biceps, shoulders and back muscles in an effort to lift herself until her arms are fully contracted. FIG. 11 depicts the upper and lower positions of the exerciser while using the device.

Figure 12:
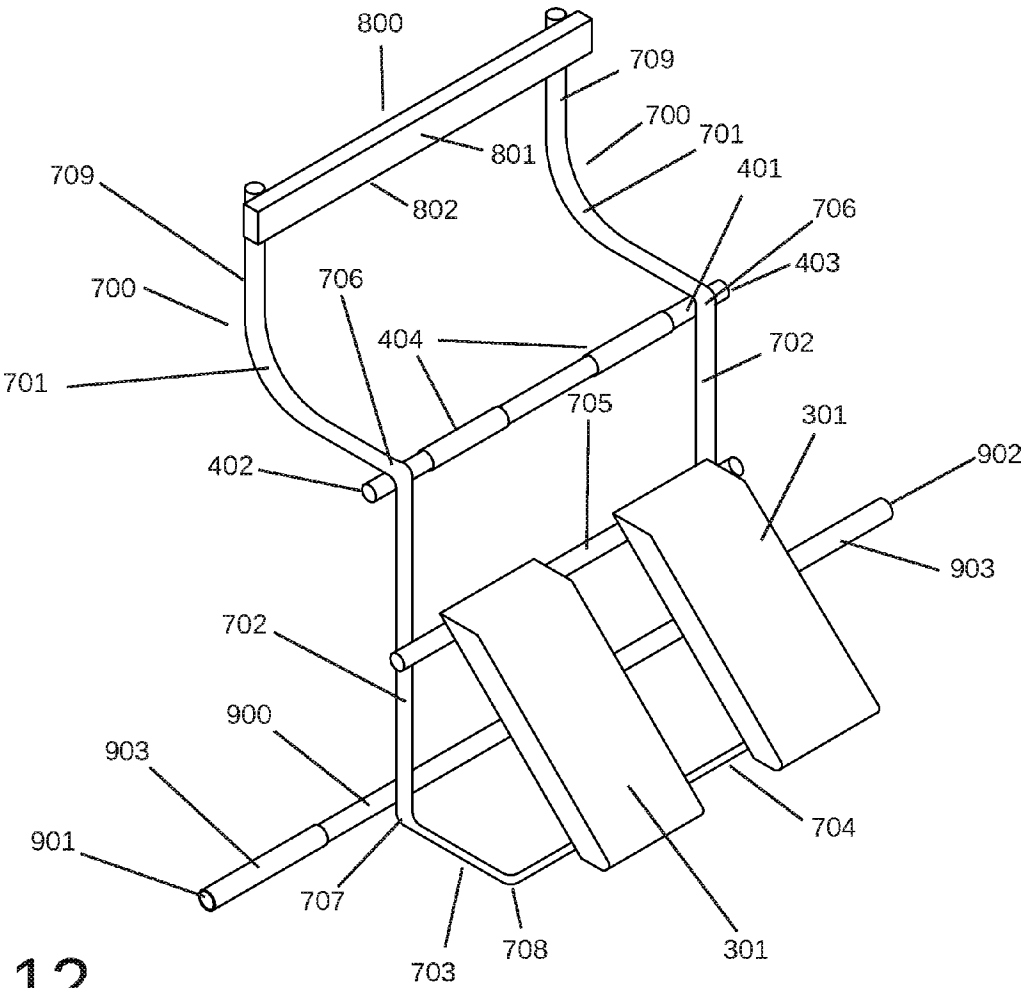
FIG. 12 depicts an example of a door-mounted embodiment of the exercise device in an isometric view.
Figure 13:
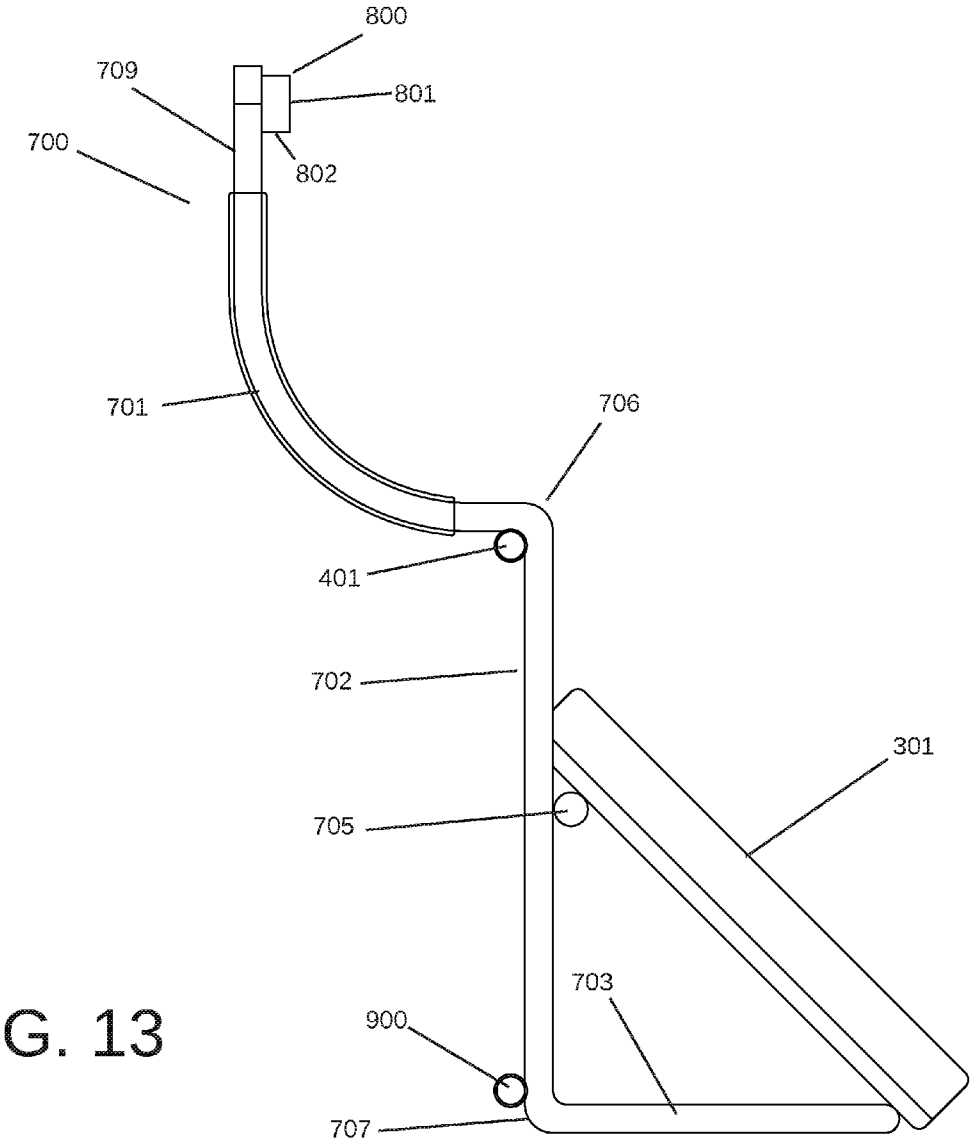
FIG. 13 depicts an example of a door-mounted embodiment of the exercise device from a side view.

FIGS. 12 and 13 depict a door mounted embodiment of the invention. The door mounted embodiment of the invention includes a rectangular rigid member 800, a curl bar 401, a supporting rigid member 900, one or more contoured tubes 700, arm support pads 301 and pad support rigid member 705.

The rectangular rigid member 800 will be made of a rigid material, preferably wood or plastic. The rectangular rigid member 800 will have a wall contact surface 801 and a door frame contact surface 802. The rectangular rigid member 800 may optionally have a protective coating on the wall contact surface 801, the door contact surface 802 or both. The protective coating will be soft material that prevents damage to the wall or door surface; preferably rubber or foam.

The curl bar 401 will be made of a rigid material, preferably a type of metal. The curl bar 401 will have a left-most end 402 and a right-most end 403. The curl bar 401 may optionally include one or more gripping areas 404 located between the left-most end 402 and the right-most end 403. The gripping areas 404 will preferably be foam wrapping the curl bar but may also include a scored section of the bar to allow the user to grasp the bar easily.

The curl bar 401 may be straight or curved to mimic the shape of an EZ curl bar.

The supporting rigid member 900 is sized to match standard door frames; generally between thirty inches and forty two inches. The left-most end 901 and right-most end 902 of the supporting rigid member 900 may optionally have a protective coating 903 on the area of contact between each end and the door frame. The protective coating 903 will preferably be a rubber or foam molding encapsulating each end of the supporting rigid member 900.

The contoured tube 700 will be made of a rigid material, preferably metal. The contoured tube 700 will have two curved sections 701, two upper pad support sections 702, two horizontal pad support sections 703 and a lower pad support section 704. The contours of the contoured tube 700 are a series of approximately ninety degree arches.

The curved sections 701 are in a vertical curved configuration forming an arch of about ninety degrees. The curved sections 701 have upper ends 709 and first transition areas 706. Each first transition area 706 marks the transition between the curved sections 701 and the upper pad support sections 702. An arch of about ninety degrees is formed at the first transition areas 706 and continues to the vertical areas of the contoured tube 700 that form the upper pad support sections 702. The upper pad support sections 702 have second transition areas 707. Each second transition area 707 marks the transition between the upper pad support sections 702 and the horizontal pad support sections 703. An arch of about ninety degrees is formed at the second transition areas 707 and continues to the horizontal area of the contoured tube 700 that form the horizontal pad support sections 703. The horizontal pad support sections 703 have third transition areas 708. An arch of about ninety degrees is formed at each third transition area 708. Each arch formed at each third transition area 708 is on the same horizontal plane as the horizontal pad support sections 703 and continues to the lower pad support section 704 of the contoured tube 700.

Although the contoured tube 700 is described in a series of sections, the contoured tube 700 may be formed from a single tube or one or more tubes joined to form the same shape.

The arm support pads 301 consist of one or more rigid blocks. The arm support pads 301 will preferably be made of wood and covered with foam and vinyl as is typical in the art to cushion an exerciser's arms.

The pad support rigid member 705 will preferably be made of metal and sized to span at least the horizontal distance between the two upper pad support sections.

The left-most and right-most ends of the horizontal rigid member 800 are joined to the upper ends 709 of the contoured tubes 700. The curl bar 401 is joined to the contoured tubes 700 at the first transition area 706. The pad support rigid member 705 is joined to the contoured tubes 700 at an area between the first transition area 706 and the second transition area 707. The supporting rigid member 900 is joined to the contoured tubes 700 at an area between the pad support rigid member 705 and the second transition area 707. The arm support pads 301 will be mounted on both the lower pad support section 704 and the pad support rigid member 705. When mounted, the arm support pads 301 will preferably form an angle between forty and fifty-five degrees.

Figure 14:
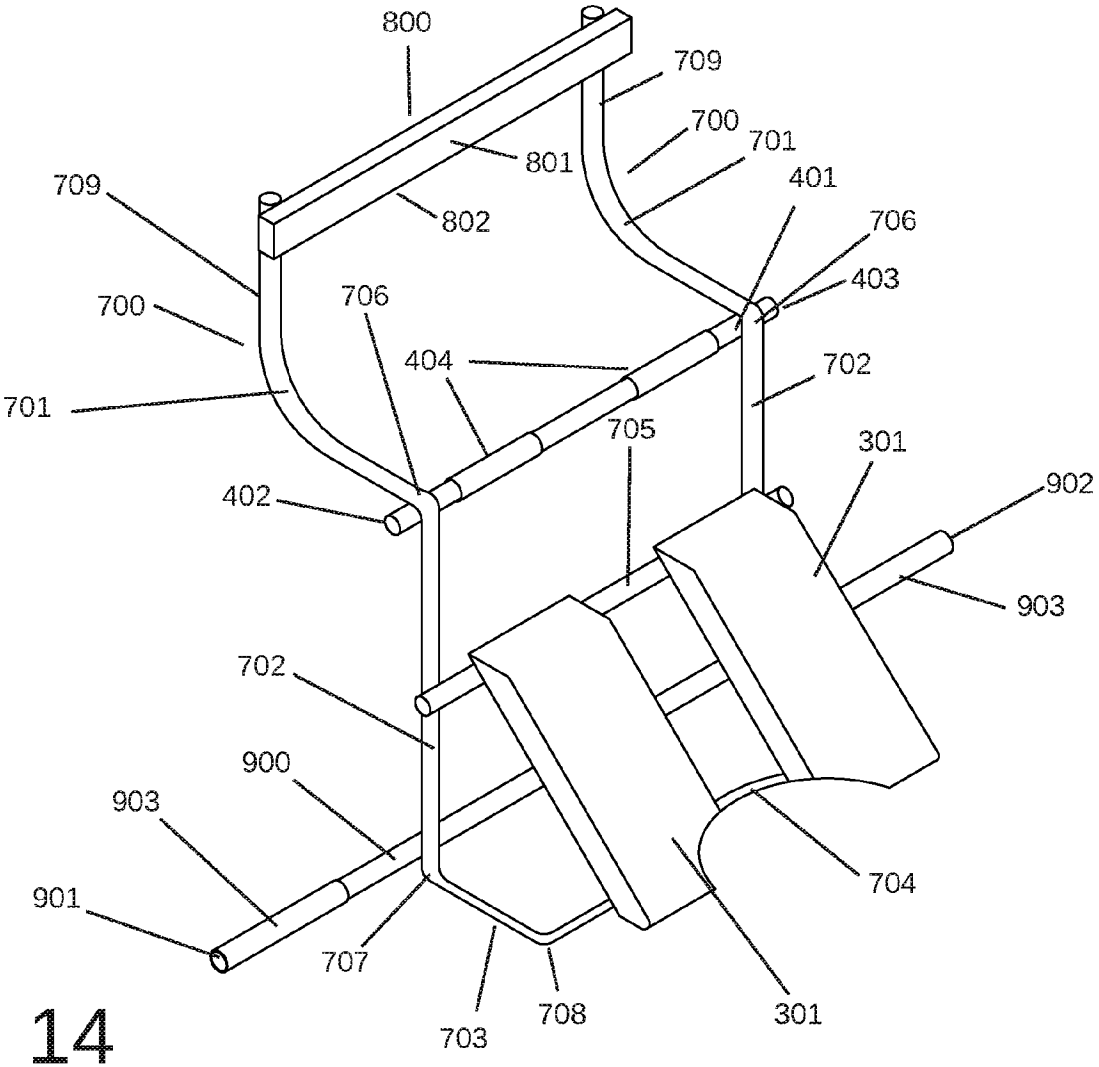
FIG. 14 depicts an example of a door-mounted embodiment of the exercise device with curved lower pad support sections.

FIG. 14 depicts an alternative embodiment of the door mounted exercise device. As shown in FIG. 14, the lower pad support section 704 may optionally contain a curve or bend in the horizontal axis towards the door frame. The curve or bend is sized to minimize the contact between the exerciser and the device. The arm support pads 301 are similarly contoured to minimize contact between the exerciser and the device.

Figure 15:
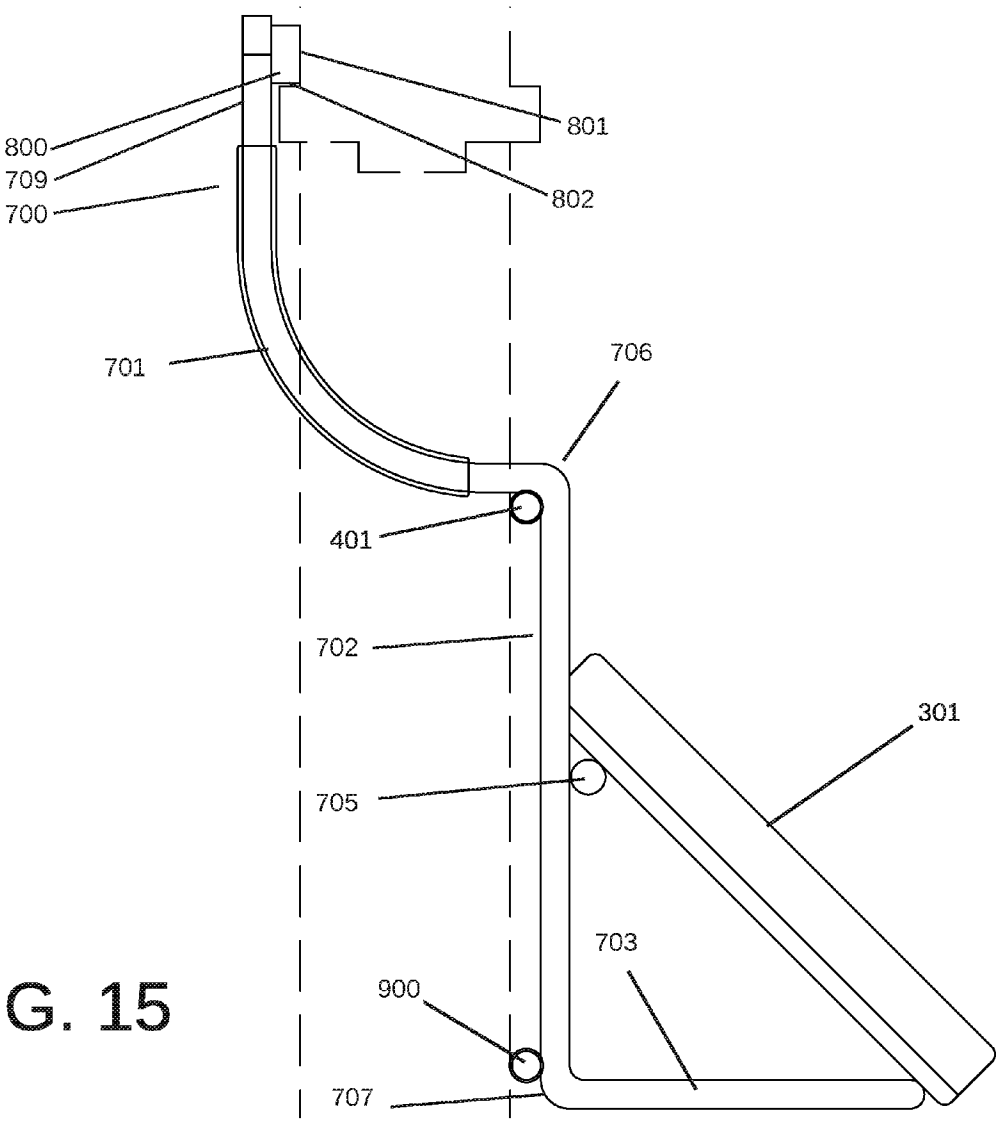
FIG. 15 depicts an example of a door-mounted embodiment of the exercise device mounted on a door frame.

FIG. 15 depicts the door-mounted exercise device mounted on a door frame, shown in dashed lines, from a side view. As shown in FIG. 15, the door-mounted exercise device is supported on the door frame by the rectangular rigid member 800 and the supporting rigid member 900.

I claim:

1. An exercise device for performing muscle building exercises using an exerciser's body weight as resistance comprising:

a pair of contoured tubes of rigid material, said contoured tubes being configured to include two upper ends, two curved sections, two upper-pad support sections, two horizontal pad support sections, two first transition areas, two second transition areas, two third transition areas and a lower pad support section, a rectangular rigid member, said rectangular rigid member having a left-most end, a right-most end a wall contact surface and a door contact surface, said left-most end of the rectangular rigid member being joined to the upper end of one said contoured tubes, said right-most end of the rectangular rigid member being joined to the upper end of the contoured tube opposite said left-most end of the rectangular rigid member, said wall contact surface being located between said left-most end of the rectangular rigid member and said right-most end of the rectangular rigid member, and on a vertical plane, said door contact surface being located between said left-most end of the rectangular rigid member and said right-most end of the rectangular rigid member, and on a horizontal plane, a curl bar, said curl bar having a left-most end and a right-most end, said left-most of the curl bar end being joined to the first transition area of one of said contoured tubes, said right-most end of the curl bar being joined to the first transition area of the contoured tube opposite the left-most end of the curl bar, a supporting rigid member, said supporting rigid member having a left-most end and a right-most end, said left-most end of said supporting rigid member being joined to the second transition area of one of said contoured tubes, said right-most end of said supporting rigid member being joined to the second transition area of said contoured tube opposite the left-most end of said supporting member, a pad support rigid member, said pad support rigid member having a left-most end and a right-most end, said left-most end of said pad support rigid member being joined to the upper pad support section of one of said contoured tubes, said right-most end of said pad support rigid member being joined to the upper pad support section of said contoured tube opposite the left-most end of said pad support rigid member, at least one arm support pad, said arm support pad being mounted on said pad support rigid member and said lower pad support section of the contoured tubes and forming an angle between forty and fifty degrees.

2. The exercise device of claim 1 wherein said pad support rigid member is configured to include a curve or bend along the horizontal plane to minimize contact between the exerciser and the exercise device.

* * * * *